US009970391B2

(12) United States Patent
Sager et al.

(10) Patent No.: US 9,970,391 B2
(45) Date of Patent: May 15, 2018

(54) TECHNIQUES FOR MONITORING PURGE FLOW AND DETECTING VAPOR CANISTER LEAKS IN AN EVAPORATIVE EMISSIONS SYSTEM

(71) Applicants: Roger C Sager, Munith, MI (US); William B Blomquist, Lake Orion, MI (US); James Daley, Jackson, MI (US); Aikaterini Tsahalou, Shelby Township, MI (US); Ronald A Yannone, Jr., Clinton, MI (US); Luis Del Rio, Ann Arbor, MI (US); Mark L Lott, Webberville, MI (US); Joseph Dekar, Jackson, MI (US)

(72) Inventors: Roger C Sager, Munith, MI (US); William B Blomquist, Lake Orion, MI (US); James Daley, Jackson, MI (US); Aikaterini Tsahalou, Shelby Township, MI (US); Ronald A Yannone, Jr., Clinton, MI (US); Luis Del Rio, Ann Arbor, MI (US); Mark L Lott, Webberville, MI (US); Joseph Dekar, Jackson, MI (US)

(73) Assignee: FCA US LLC, Auburn Hills, MI (US)

( * ) Notice: Subject to any disclaimer, the term of this patent is extended or adjusted under 35 U.S.C. 154(b) by 189 days.

(21) Appl. No.: 15/164,479

(22) Filed: May 25, 2016

(65) Prior Publication Data

US 2017/0342946 A1 Nov. 30, 2017

(51) Int. Cl.
*F02M 1/00* (2006.01)
*F02M 25/08* (2006.01)
(Continued)

(52) U.S. Cl.
CPC ..... *F02M 25/0827* (2013.01); *F02D 41/004* (2013.01); *F02D 41/042* (2013.01);
(Continued)

(58) Field of Classification Search
CPC ..... F02M 37/0023; F02M 37/0029; F02M 37/025; F02M 25/0836; F02M 2025/0863;
(Continued)

(56) References Cited

U.S. PATENT DOCUMENTS 3,888,223 A 6/1975 Mondt
5,390,645 A 2/1995 Cook et al.
(Continued)

FOREIGN PATENT DOCUMENTS

WO 2015049157 A1 4/2015

OTHER PUBLICATIONS

U.S. Appl. No. 15/164,470, filed May 25, 2016, Roger C. Sager et al.
(Continued)

*Primary Examiner* — John Kwon
(74) *Attorney, Agent, or Firm* — Ralph E Smith

(57) ABSTRACT

A diagnostic method and system includes a control valve configured to control an amount of air drawn into an evaporative emissions (EVAP) system through an air filter and a vapor canister, and a pressure sensor configured to measure pressure in the EVAP system. The system also includes a controller configured to detect an engine idle-to-off transition and, in response to detecting the engine idle-to-off transition: receive a first pressure from the pressure sensor, fully open a purge valve connected between the vapor canister and an intake port of an engine, fully close the control valve, monitor one or more second pressures received from the pressure sensor, and detect a malfunction
(Continued)

of the EVAP system based on the first pressure, at least one of the one or more second pressures, and a diagnostic threshold.

18 Claims, 3 Drawing Sheets

(51) Int. Cl.
*F02D 41/00* (2006.01)
*F02D 41/22* (2006.01)
*F02D 41/04* (2006.01)

(52) U.S. Cl.
CPC ..... *F02D 41/22* (2013.01); *F02M 25/0836* (2013.01); *F02M 25/0854* (2013.01); *F02D 2041/225* (2013.01)

(58) Field of Classification Search
CPC ..... F02D 2250/02; F02D 41/0032; F02D 41/004; F02D 41/0045; F02D 19/0621
USPC ... 123/510, 516, 518–520, 198 D, 357, 698; 73/118.02, 861.01, 861.04
See application file for complete search history.

(56) References Cited

U.S. PATENT DOCUMENTS

| | | | | |
|---|---|---|---|---|
| 6,318,345 | B1 | 11/2001 | Weber et al. | |
| 6,321,727 | B1 | 11/2001 | Reddy et al. | |
| 6,659,087 | B1 * | 12/2003 | Reddy | F02D 41/0045 123/357 |
| 7,077,112 | B2 | 7/2006 | Mitani et al. | |
| 7,566,358 | B2 | 7/2009 | Hart et al. | |
| 8,689,613 | B2 | 4/2014 | Perry | |
| 9,752,521 | B2 * | 9/2017 | Dudar | F02D 41/064 |
| 2003/0110836 | A1 | 6/2003 | Cho | |
| 2005/0240336 | A1 * | 10/2005 | Reddy | F02D 41/0045 701/103 |
| 2015/0019066 | A1 | 1/2015 | Dudar et al. | |
| 2015/0083089 | A1 | 3/2015 | Pearce et al. | |
| 2015/0322901 | A1 * | 11/2015 | Kragh | F02M 25/08 123/520 |
| 2016/0194999 | A1 * | 7/2016 | Hakeem | F01P 7/10 123/41.05 |
| 2017/0082038 | A1 * | 3/2017 | Dudar | F02M 25/0836 |

OTHER PUBLICATIONS

U.S. Appl. No. 15/164,464, filed May 25, 2016, Joseph Dekar et al.
U.S. Appl. No. 15/164,462, filed May 25, 2016, Joseph Dekar et al.

* cited by examiner

TECHNIQUES FOR MONITORING PURGE FLOW AND DETECTING VAPOR CANISTER LEAKS IN AN EVAPORATIVE EMISSIONS SYSTEM

FIELD

The present application generally relates to evaporative emissions (EVAP) systems and, more particularly, to diagnostic techniques for monitoring purge flow and detecting vapor canister leaks.

BACKGROUND

Conventional evaporative emissions (EVAP) systems include a vapor canister that evaporates from liquid fuel (e.g., gasoline) stored in a fuel tank of the vehicle. Engine vacuum is utilized to deliver the fuel vapor from the vapor canister to the engine through vapor transport lines and into intake ports of the engine. Vehicles are typically required to perform diagnostic routines on various components of the EVAP system to detect malfunctions (leaks, blockages, etc.). If unaddressed, malfunctions of the EVAP system could result in fuel vapor being released into the atmosphere.

Conventional EVAP system diagnostic routines, however, are typically intrusive. That is, these diagnostic routines are forced during engine operation, even at the expense of performance/fuel economy. Some conventional diagnostic routines also utilize additional testing components, such as passive mechanical devices, which potentially increases costs. Accordingly, while such EVAP systems work for their intended purpose, there remains a need for improvement in the relevant art.

SUMMARY

According to a first aspect of the invention, a diagnostic system for an evaporative emissions (EVAP) system configured to control a flow of a fuel vapor is presented. In one exemplary implementation, the system includes a control valve connected between a vapor canister of the EVAP system and an air filter connected to an atmosphere, the control valve being configured to control an amount of air drawn through the air filter and the vapor canister; a pressure sensor configured to measure pressure in the EVAP system at a point (i) in the vapor canister, (ii) in a first vapor transport line between the vapor canister and a fuel tank, or (iii) in a second vapor transport line between the vapor canister and the control valve; and a controller configured to detect an engine idle-to-off transition and, in response to detecting the engine idle-to-off transition: receive a first pressure from the pressure sensor; after receiving the first pressure, (i) fully open a purge valve connected between the vapor canister and an intake port of an engine and (ii) fully close the control valve; after fully opening the purge valve and fully closing the control valve, monitor one or more second pressures received from the pressure sensor; and detect a malfunction of the EVAP system based on the first pressure, at least one of the one or more second pressures, and a diagnostic threshold.

According to a second aspect of the invention, a diagnostic method for an EVAP system configured to control a flow of a fuel vapor is presented. In one exemplary implementation, the method includes detecting, by a controller, an engine idle-to-off transition; and in response to detecting the engine idle-to-off transition: receiving, by the controller and from a pressure sensor, a first pressure, the pressure sensor being configured to measure pressure in the EVAP system at a point (i) in a vapor canister of the EVAP system, (ii) in a first vapor transport line between the vapor canister and a fuel tank, or (iii) in a second vapor transport line between the vapor canister and a control valve connected between the vapor canister and an air filter connected to an atmosphere; after receiving the first pressure, (i) fully opening, by the controller, a purge valve connected between the vapor canister and an intake port of an engine and (ii) fully closing, by the controller, the control valve, the control valve being configured to control an amount of air drawn through the air filter and the vapor canister; after fully opening the purge valve and fully closing the control valve, monitoring, by the controller, one or more second pressures received from the pressure sensor; and detecting, by the controller, a malfunction of the EVAP system based on the first pressure, at least one of the one or more second pressures, and a diagnostic threshold.

In some implementations, the malfunction is a blockage in the EVAP system. In some implementations, the controller is further configured to: determine a pressure difference between the first measured pressure and one of the one or more second measured pressures; and detect the blockage in the EVAP system when the pressure difference is less than the diagnostic threshold, wherein the diagnostic threshold is indicative of a minimum acceptable pressure difference for a properly functioning EVAP system. In some implementations, the blockage is in a third vapor transport line between the vapor canister and the purge valve.

In some implementations, the malfunction is a leak in the vapor canister. In some implementations, the controller is further configured to: determine a pressure decay rate based on the first pressure and the one or more second pressures; and detect the vapor canister leak when the pressure decay rate is greater than the diagnostic threshold, wherein the diagnostic threshold is indicative of a maximum acceptable pressure decay rate for a properly functioning EVAP system.

In some implementations, the engine idle-to-off transition is a transition from an engine idle period to an engine-off period in response to a key-off event. In some implementations, a throttle valve of the engine is fully-closed during the engine idle period such that substantial engine vacuum builds in an intake manifold of the engine that is connected to the intake port. In some implementations, opening the purge valve causes the substantial engine vacuum to be transferred into the EVAP system.

Further areas of applicability of the teachings of the present disclosure will become apparent from the detailed description, claims and the drawings provided hereinafter, wherein like reference numerals refer to like features throughout the several views of the drawings. It should be understood that the detailed description, including disclosed embodiments and drawings referenced therein, are merely exemplary in nature intended for purposes of illustration only and are not intended to limit the scope of the present disclosure, its application or uses. Thus, variations that do not depart from the gist of the present disclosure are intended to be within the scope of the present disclosure.

DETAILED DESCRIPTION

As previously mentioned, conventional diagnostics for evaporative emissions (EVAP) systems are intrusive and/or require additional componentry. Accordingly, improved diagnostic techniques are presented for detecting malfunctions of an EVAP system. These techniques leverage the transition from engine idle to engine-off. At engine idle, a throttle valve is fully closed and there is a large vacuum in an intake manifold of the engine. At the transition to engine-off, this vacuum is "transferred" to the EVAP system for diagnostic purposes. More particularly, a purge valve at an intake port of the engine is opened, which causes a pressure differential to be created in the EVAP system. This pressure differential is then utilized as part of a diagnostic routine for a component of the EVAP system, such as a leak or blockage in the vapor canister or one of the vapor transport lines.

Figure 1:
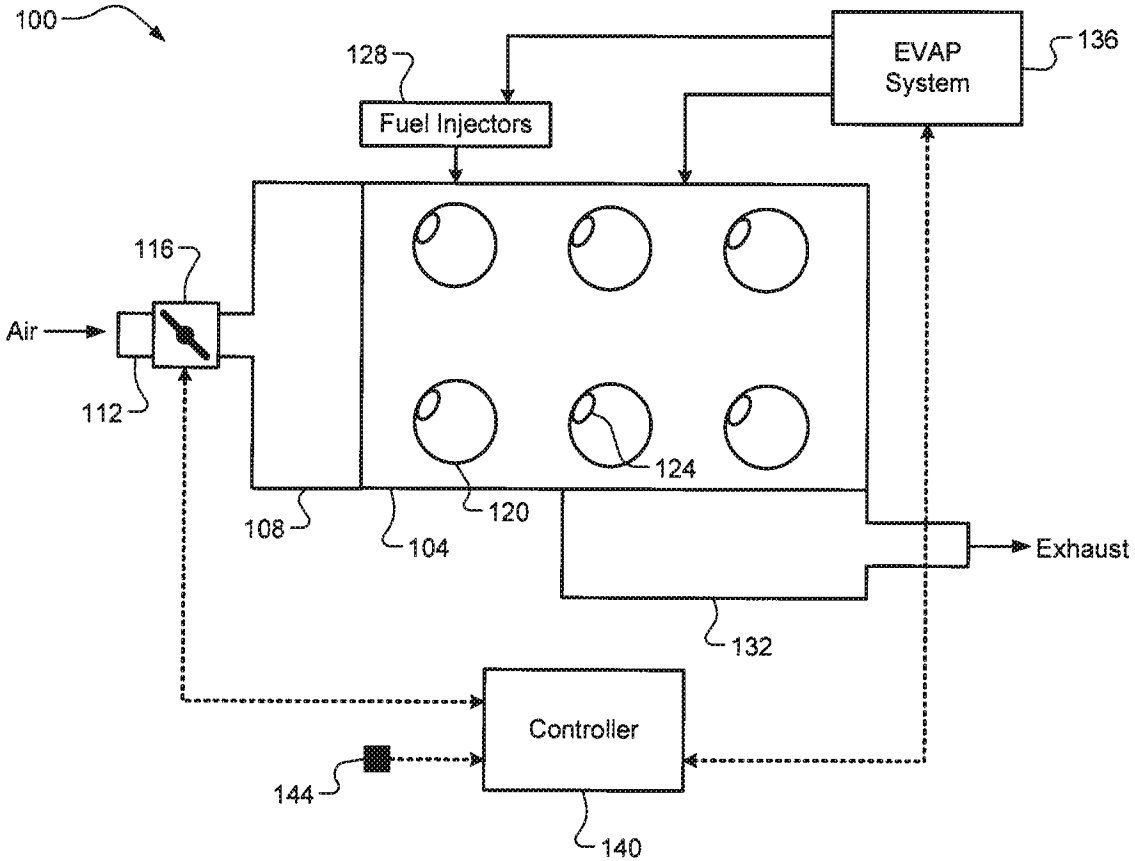
FIG. 1 is a diagram of an example engine system including an evaporative emissions (EVAP) system according to the principles of the present disclosure.

Referring now to FIG. 1, an example engine system 100 is illustrated. The engine system 100 includes an engine 104 that is configured to combust an air/fuel mixture to generate drive torque. The engine draws air into an intake manifold 108 through an induction system 112 that is regulated by a throttle valve 116. The air in the intake manifold 108 is distributed to a plurality of cylinders 120 via respective intake ports 124. While six cylinders are shown, the engine 104 could have any number of cylinders. Fuel injectors 128 are configured to inject liquid fuel (e.g., gasoline) via the intake ports 124 (port fuel injection) or directly into the cylinders 120 (direct fuel injection). While not shown, it will be appreciated that the engine 104 could include other components, such as a boost system (supercharger, turbocharger, etc.).

Intake valves (not shown) control the flow of the air or air/fuel mixture into the cylinders 120. The air/fuel mixture is compressed by pistons (not shown) within the cylinders 120 and combusted (e.g., by spark plugs (not shown)) to drive the pistons, which rotate a crankshaft (not shown) to generate drive torque. Exhaust gas resulting from combustion is expelled from the cylinders 120 via exhaust valves/ports (not shown) and into an exhaust treatment system 132. The exhaust treatment system 132 treats the exhaust gas before releasing it into the atmosphere. An EVAP system 136 selectively provides fuel vapor to the engine 104 via the intake ports 124. While delivery via the intake ports 124 is shown and discussed herein, it will be appreciated that the fuel vapor could be delivered to the engine 104 directly into the cylinders 120.

The EVAP system 136 includes at least a vapor canister (not shown), a pressure sensor (not shown), and a control valve (not shown). The EVAP control system 136 is monitored and controlled by a controller 140. The controller 140 is any suitable controller or control unit for communicating with and commanding the EVAP system 136. In one exemplary implementation, the controller 140 includes one or more processors and a non-transitory memory storing a set of instructions that, when executed by the one or more processors, cause the controller 140 to perform a specific diagnostic technique. The controller 140 is configured to receive information from one or more vehicle sensors 144. Examples of the vehicle sensors 144 include a key on/off sensor for detecting key-on and key-off events.

Figure 2:
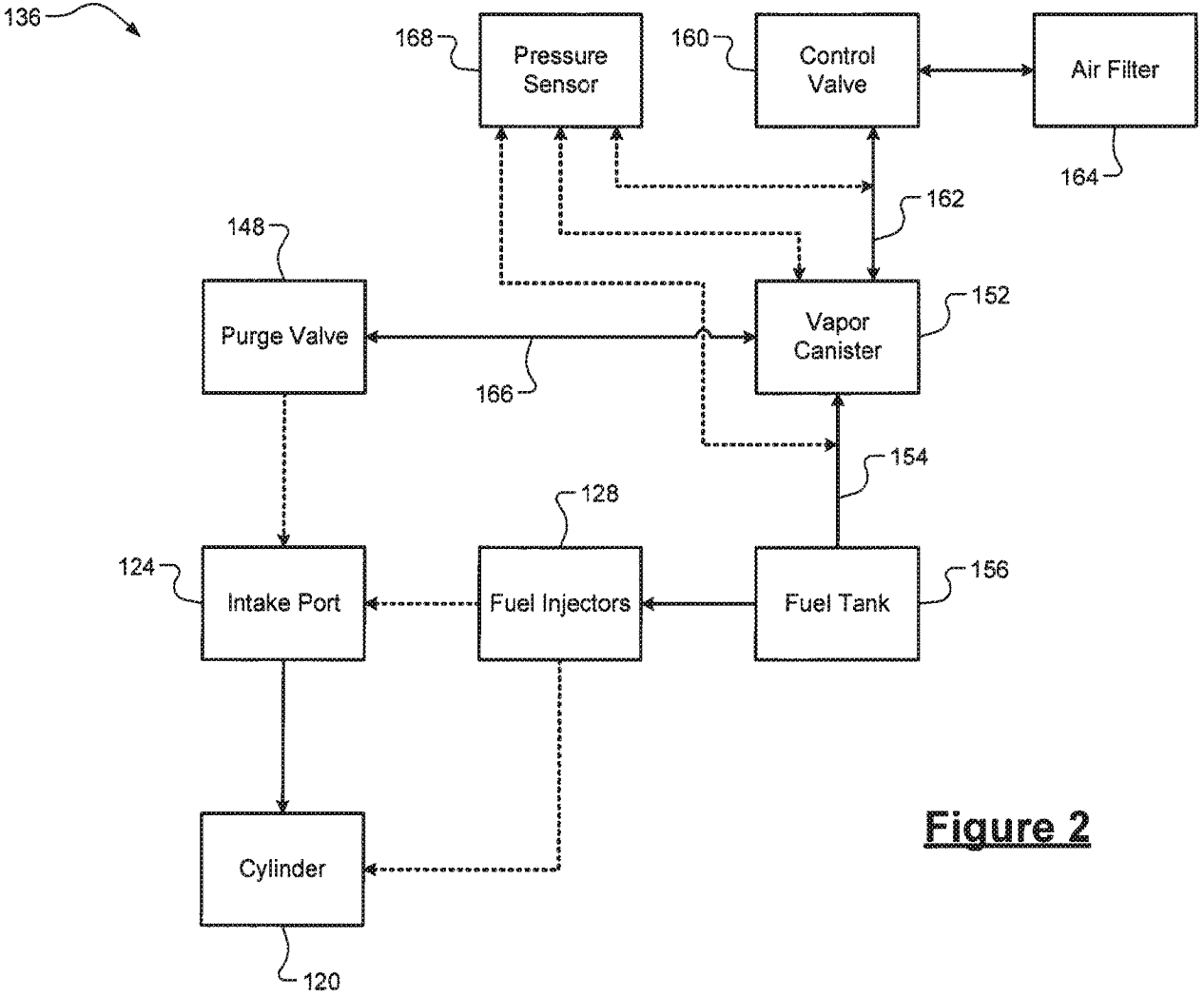
FIG. 2 is a functional block diagram of an example configuration of the EVAP system according to the principles of the present disclosure.

Referring now to FIG. 2, a functional block diagram of an example configuration of the EVAP control system 136 is illustrated. While the EVAP control system 136 is only shown with respect to a single intake port 124 and single cylinder 120 of the engine 104, it will be appreciated that the fuel vapor could be supplied to all of the intake ports 124 and/or cylinders 120. The EVAP control system 136 is configured to deliver fuel vapor to the intake ports 124 of the engine 104 via purge valves 148. For example, the purge valves 148 could be disposed within holes or apertures in a wall of the intake ports 124. As previously mentioned, it will be appreciated that the purge valves 148 could be configured to deliver the fuel vapor directly to the cylinders 108, e.g., via different holes or apertures. One example of the purge valves is a butterfly-type valve, but it will be appreciated that any suitable valve configured to regulate the flow of pressurized fuel vapor could be utilized.

The EVAP control system 136 includes a vapor canister 152 that traps fuel vapor that evaporates from liquid fuel stored in a fuel tank 156. This fuel vapor can be directed from the fuel tank 156 to the vapor canister 152 via a first vapor transport line 154, which could also be referred to as an evaporation line or duct. In one exemplary implementation, the vapor canister 152 includes (e.g., is lined with) activated carbon (e.g., charcoal) that adsorbs the fuel vapor. The fuel vapor trapped in the vapor canister 152 is selectively delivered to the intake port 124 of the engine 104 via the purge valves 148 and a third vapor transport line 162. As previously discussed, EVAP control systems utilize engine vacuum to draw fresh air (and trapped fuel vapor) through the EVAP system 136 for engine delivery.

Thus, the vapor canister 152 is also associated with a control valve 160 or other suitable controlled venting device that allows fresh air to be drawn through an air filter 164 and the vapor canister 152, thereby pulling the trapped fuel vapor with it. The vapor canister 152 and the control valve 160 are connected via a second vapor transport line 166. One example of the control valve 160 is a latching valve or a latching solenoid valve. Such valves require minimal current to remain in a specific state, and thus could be ideal for power consumption purposes. In one exemplary implementation, the control valve 160 is a device that is further configured to measure pressure in the second vapor transport line 166. Thus, in such implementations, a pressure sensor 168 could be eliminated.

The pressure sensor 168 is any suitable pressure sensor configured to measure a pressure a point in the EVAP system 136. This measurement point should be a point in the EVAP system 136 that is near the vapor canister 152, but is not in the third vapor transport line 166 between the vapor canister 152 and the engine 104. The reasoning for this is because engine vacuum is effectively transferred to the EVAP system 136 from the engine 104 for diagnostic purposes, and leaks/blockage are then monitored for at one of these other nearby measurement points, which is described in greater detail below. Non-limiting examples of the measurement point include (i) in the second vapor transport line 166, as described above, (ii) in the first vapor transport line 154, and (iii) within the vapor canister 152.

The controller 140 can control operation of the EVAP system 136 to perform the diagnostic techniques of the present disclosure. First, the controller 140 detects an engine idle-to-off transition. As previously discussed herein, at engine idle, there is a substantial engine vacuum (e.g., 40-50 kilopascals, or kPa) in the intake manifold 108 of the engine 104 compared to atmospheric pressure. This is because the throttle valve 116 is fully closed during the engine idle period. The intake manifold 108 is fluidly connected to the intake ports 124. Thus, by opening the purge valves 148, this engine vacuum is effectively transferred to the EVAP system 136 for diagnostic purposes. Thus, upon detecting a subsequent key-off event (e.g., using sensor 144), the controller 140 fully opens the purge valve 148 to create a pressure differential in the EVAP system 136. By doing so at the engine-off transition, this process is non-intrusive to engine operation.

Along with fully opening the purge valve 148, the controller 140 fully closes the control valve 160. By fully closing the control valve 160, the EVAP system 136 is fully closed off from the atmosphere, which provides for better diagnostic accuracy. After the engine idle-to-off transition, fully opening the purge valve 148, and fully closing the control valve 160, one or both of the diagnostic routines of the present disclosure are executable. As previously mentioned herein, the first diagnostic routine has to do with monitoring purge flow for verification or, in other words, detecting flow blockage in the EVAP system 136 (e.g., in the third vapor transport line 166). The second diagnostic routine, on the other hand, has to do with detecting leakage of the vapor canister 152 or its associated vapor transport lines 154, 162, 166.

The first diagnostic routine involves the controller 140 obtaining a first pressure from the pressure sensor 168 at a time at or before fully opening the purge valve 148 and fully closing the control valve 160. After a period of time, the controller 140 obtains a second pressure from the pressure sensor 168. During this period of time, a pressure differential has been created in the EVAP system 136. Due to blockage, however, the pressure in the EVAP system 136 could change less than expected. Thus, a pressure difference between the first and second pressures is determined by the controller 140 and compared to a diagnostic threshold. This diagnostic threshold is indicative of a minimum acceptable pressure difference for a properly functioning EVAP system 136. This diagnostic threshold could be preset or dynamically calibrated over time. When the pressure difference does not exceed this diagnostic threshold, the controller 140 detects a blockage malfunction of the EVAP system 136.

The second diagnostic routine similarly involves the controller 140 obtaining the first pressure from the pressure sensor 168 at a time at or before fully opening the purge valve 148 and fully closing the control valve 160. Over the following period of time, however, the controller 140 obtains at least one second pressure from the pressure sensor 168 as part of determining a pressure decay rate. This period, for example, could be much longer than the period for the first diagnostic routine. Preferably, the controller 140 also obtains a plurality of second pressures from the pressure sensor 168 over the period. These second pressure(s) are then used to determine a pressure decay rate in the EVAP system 136. The controller 140 then compares the pressure decay rate to the diagnostic threshold. For this routine, the diagnostic threshold is indicative of a maximum acceptable pressure decay rate for a properly functioning EVAP system 136. When the pressure decay rate exceeds this diagnostic threshold, the controller 140 detects a leakage in the vapor canister 152 or one of its associated vapor line 154, 162, 166.

Upon detecting one of the malfunctions discussed above, the controller 140 could perform some sort of action. One example action is setting a fault, such as by activating a malfunction indicator lamp (not shown). Another example action is adjusting operation of the engine 104, such as disabling the EVAP system 136 or commanding some sort of limp-home mode so the vehicle is able to reach a service center. It will be appreciated that other actions could be taken by the controller 140. It will also be appreciated that the controller 140 could implement some sort of bookkeeping process by which a number of malfunctions are counted and, once a threshold is reached, action is then taken by the controller 140. These diagnostic routines are also very robust and more accurate because they are executable during each operation cycle (engine off→on→off), as opposed to conventional techniques that operated periodically (e.g., only on cold starts).

Figure 3:
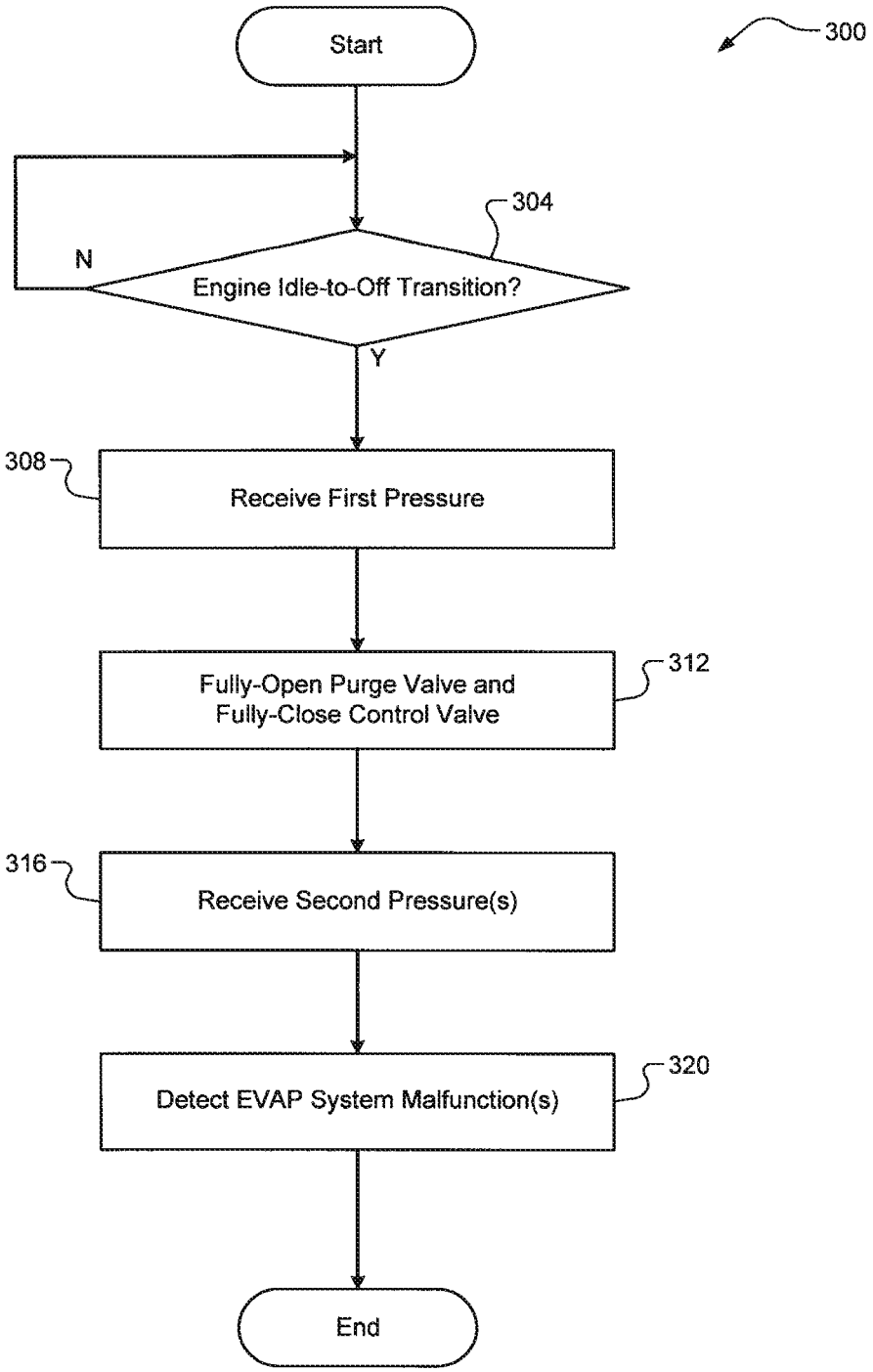
FIG. 3 is a flow diagram of an example diagnostic method for detecting malfunctions of the EVAP system according to the principles of the present disclosure.

Referring now to FIG. 3, a flow diagram of an example method 300 for diagnosing a malfunction of the EVAP system 136 is illustrated. At 304, the controller 140 detects whether an engine idle-to-off transition has occurred. In some implementations, an engine idle period (prior to the engine-off transition) must be greater than a particular length of time in order for the substantial vacuum to build. If true, the method 300 proceeds to 308. Otherwise, the method 300 ends or returns to 304. At 308, the controller 140 receives, from the pressure sensor 168, a first pressure. At 312, the controller 140 fully opens the purge valve 148 and fully closes the control valve 160, which effectively transfers the engine vacuum to the EVAP system 136. At 316, the controller 140 receives, from the pressure sensor 168, one or more second pressures received from the pressure sensor. For the first diagnostic routine, only one second pressure is necessary to detect the pressure difference from the first pressure. For the second diagnostic routine, however, multiple second pressures are preferred to detect the pressure decay rate from the second pressure.

At 320, the controller 140 detects a malfunction of the EVAP system 136 based on the first pressure, at least one of the one or more second pressures, and a diagnostic threshold. For the first diagnostic routine, blockage in the EVAP system 136 is detected when the pressure difference is less than the diagnostic threshold indicative of a minimum acceptable pressure difference for a properly functioning EVAP system 136. For the second diagnostic routine, on the other hand, vapor canister or associated vapor line leakage in the EVAP system 136 is detected when the pressure decay rate is greater than the diagnostic threshold indicative of a minimum acceptable pressure decay rate for a properly functioning EVAP system 136. The method 300 then ends or returns to 304 for one or more additional cycles (e.g., after a subsequent engine-on event).

As previously discussed, it will be appreciated that the term "controller" as used herein refers to any suitable control device or set of multiple control devices that is/are configured to perform at least a portion of the techniques of the present disclosure. Non-limiting examples include an application-specific integrated circuit (ASIC), one or more processors and a non-transitory memory having instructions stored thereon that, when executed by the one or more processors, cause the controller to perform a set of operations corresponding to at least a portion of the techniques of the present disclosure. The one or more processors could be either a single processor or two or more processors operating in a parallel or distributed architecture.

It should be understood that the mixing and matching of features, elements, methodologies and/or functions between various examples may be expressly contemplated herein so that one skilled in the art would appreciate from the present teachings that features, elements and/or functions of one example may be incorporated into another example as appropriate, unless described otherwise above.

What is claimed is:

1. A diagnostic system for an evaporative emissions (EVAP) system configured to control a flow of a fuel vapor, the system comprising:

a control valve connected between a vapor canister of the EVAP system and an air filter connected to an atmosphere, the control valve being configured to control an amount of air drawn through the air filter and the vapor canister;

a pressure sensor configured to measure pressure in the EVAP system at a point (i) in the vapor canister, (ii) in a first vapor transport line between the vapor canister and a fuel tank, or (iii) in a second vapor transport line between the vapor canister and the control valve; and a controller configured to detect an engine idle-to-off transition and, in response to detecting the engine idle-to-off transition:

receive a first pressure from the pressure sensor;

after receiving the first pressure, (i) fully open a purge valve connected between the vapor canister and an intake port of an engine and (ii) fully close the control valve;

after fully opening the purge valve and fully closing the control valve, monitor one or more second pressures received from the pressure sensor; and detect a malfunction of the EVAP system based on the first pressure, at least one of the one or more second pressures, and a diagnostic threshold.

2. The system of claim 1, wherein the malfunction is a blockage in the EVAP system.

3. The system of claim 2, wherein the controller is further configured to:

determine a pressure difference between the first measured pressure and one of the one or more second measured pressures; and detect the blockage in the EVAP system when the pressure difference is less than the diagnostic threshold, wherein the diagnostic threshold is indicative of a minimum acceptable pressure difference for a properly functioning EVAP system.

4. The system of claim 3, wherein the blockage is in a third vapor transport line between the vapor canister and the purge valve.

5. The system of claim 1, wherein the malfunction is a leak in the vapor canister.

6. The system of claim 5, wherein the controller is further configured to:

determine a pressure decay rate based on the first pressure and the one or more second pressures; and detect the vapor canister leak when the pressure decay rate is greater than the diagnostic threshold, wherein the diagnostic threshold is indicative of a maximum acceptable pressure decay rate for a properly functioning EVAP system.

7. The system of claim 1, wherein the engine idle-to-off transition is a transition from an engine idle period to an engine-off period in response to a key-off event.

8. The system of claim 7, wherein a throttle valve of the engine is fully-closed during the engine idle period such that substantial engine vacuum builds in an intake manifold of the engine that is connected to the intake port.

9. The system of claim 8, wherein opening the purge valve causes the substantial engine vacuum to be transferred into the EVAP system.

10. A diagnostic method for an evaporative emissions (EVAP) system configured to control a flow of a fuel vapor, the method comprising:

detecting, by a controller, an engine idle-to-off transition; and in response to detecting the engine idle-to-off transition:

receiving, by the controller and from a pressure sensor, a first pressure, the pressure sensor being configured to measure pressure in the EVAP system at a point (i) in a vapor canister of the EVAP system, (ii) in a first vapor transport line between the vapor canister and a fuel tank, or (iii) in a second vapor transport line between the vapor canister and a control valve connected between the vapor canister and an air filter connected to an atmosphere;

after receiving the first pressure, (i) fully opening, by the controller, a purge valve connected between the vapor canister and an intake port of an engine and (ii) fully closing, by the controller, the control valve, the control valve being configured to control an amount of air drawn through the air filter and the vapor canister;

after fully opening the purge valve and fully closing the control valve, monitoring, by the controller, one or more second pressures received from the pressure sensor; and detecting, by the controller, a malfunction of the EVAP system based on the first pressure, at least one of the one or more second pressures, and a diagnostic threshold.

11. The method of claim 10, wherein the malfunction is a blockage in the EVAP system.

12. The method of claim 11, further comprising:

determining, by the controller, a pressure difference between the first measured pressure and one of the one or more second measured pressures; and detecting, by the controller, the blockage in the EVAP system when the pressure difference is less than the diagnostic threshold, wherein the diagnostic threshold is indicative of a minimum acceptable pressure difference for a properly functioning EVAP system.

13. The method of claim 12, wherein the blockage is in a third vapor transport line between the vapor canister and the purge valve.

14. The method of claim 10, wherein the malfunction is a leak in the vapor canister.

15. The method of claim 14, further comprising:

determining, by the controller, a pressure decay rate based on the first pressure and the one or more second pressures; and detecting, by the controller, the vapor canister leak when the pressure decay rate is greater than the diagnostic threshold, wherein the diagnostic threshold is indicative of a maximum acceptable pressure decay rate for a properly functioning EVAP system.

16. The method of claim 10, wherein the engine idle-to-off transition is a transition from an engine idle period to an engine-off period in response to a key-off event.

17. The method of claim 16, wherein a throttle valve of the engine is fully-closed during the engine idle period such that substantial engine vacuum builds in an intake manifold of the engine that is connected to the intake port.

18. The method of claim 17, wherein opening the purge valve causes the substantial engine vacuum to be transferred into the EVAP system.

* * * * *